US009989058B2

(12) United States Patent
Al-Hasan et al.

(10) Patent No.: US 9,989,058 B2
(45) Date of Patent: Jun. 5, 2018

(54) ELECTRIC MOTOR VEHICLE VACUUM PUMP ARRANGEMENT

(71) Applicant: PIERBURG PUMP TECHNOLOGY GMBH, Neuss (DE)

(72) Inventors: Nabil Salim Al-Hasan, Korschenbroich (DE); Mathias Zill, Nossen (DE); Sebastian Cramer, Pulheim (DE); Daniel Mueller, Hilden (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 356 days.

(21) Appl. No.: 14/772,784

(22) PCT Filed: Mar. 5, 2013

(86) PCT No.: PCT/EP2013/054438
§ 371 (c)(1),
(2) Date: Sep. 4, 2015

(87) PCT Pub. No.: WO2014/135202
PCT Pub. Date: Sep. 12, 2014

(65) Prior Publication Data

US 2016/0017885 A1 Jan. 21, 2016

(51) Int. Cl.
*F04C 29/06* (2006.01)
*F04C 29/04* (2006.01)
(Continued)

(52) U.S. Cl.
CPC ..... *F04C 29/06* (2013.01); *F04C 11/008* (2013.01); *F04C 18/344* (2013.01);
(Continued)

(58) Field of Classification Search
CPC ..... F04C 29/06; F04C 29/066; F04C 29/045; F04C 18/344; F04C 11/008;
(Continued)

(56) References Cited

U.S. PATENT DOCUMENTS 4,447,192 A * 5/1984 Tuckey ..... F04C 15/00 310/90
5,002,467 A 3/1991 Talaski et al.
(Continued)

FOREIGN PATENT DOCUMENTS

| | | | |
|---|---|---|---|
| DE | 40 02 275 | A1 | 8/1990 |
| DE | 199 36 644 | A1 | 2/2001 |
| EP | 0 081 659 | A1 | 6/1983 |
| EP | 0 459 116 | A1 | 4/1991 |
| EP | 2 253 848 | A2 | 11/2010 |
| EP | 2 546 457 | A2 | 1/2013 |

*Primary Examiner* — Charles Freay
(74) *Attorney, Agent, or Firm* — Norman B. Thot

(57) ABSTRACT

An electric vehicle vacuum pump assembly includes a combination, a separate acoustic barrier casing configured to encase the combination in each of a radially-spaced relationship and an axially-spaced relationship, and an annular gastight attenuation assembly radially arranged between the separate acoustic barrier casing on a first side and the combination on a second side. The combination comprises a pump unit and a drive motor comprising a rotor space, a stator space, a ventilation inlet, and a ventilation outlet. The rotor space comprises a motor rotor, and the stator space comprises a motor stator. The separate acoustic barrier casing comprises an intake connection and a discharge connection. The ventilation inlet and the ventilation outlet of the drive motor are configured to provide a forced ventilation past the annular gastight attenuation assembly and through at least one of the rotor space and the stator space.

13 Claims, 4 Drawing Sheets

(51) Int. Cl.
*F04C 29/00* (2006.01)
*F04C 11/00* (2006.01)
*F04C 18/344* (2006.01)

(52) U.S. Cl.
CPC ..... *F04C 29/0035* (2013.01); *F04C 29/045* (2013.01); *F04C 29/066* (2013.01); *F04C 2240/30* (2013.01); *F04C 2240/40* (2013.01); *F04C 2270/12* (2013.01)

(58) Field of Classification Search
CPC ..... F04C 29/0035; F04C 2270/12; F04C 2240/30; F04C 2240/40; F04B 53/002; F04B 53/003; F04B 39/0033; F04B 39/0044
USPC ..... 417/371
See application file for complete search history.

(56) References Cited

U.S. PATENT DOCUMENTS 5,145,335 A * 9/1992 Abelen ..... F04B 39/066 417/410.3
6,155,801 A * 12/2000 Elnar ..... A61H 33/028 417/363
6,491,505 B1 12/2002 Hueser et al.
2002/0002906 A1* 1/2002 Fuesser ..... F04B 39/0033 96/381
2005/0287007 A1* 12/2005 Leonhard ..... F04B 53/003 417/11
2006/0216569 A1* 9/2006 Choi ..... F04B 53/003 429/508
2010/0290933 A1 11/2010 Tabata et al.
2012/0251356 A1* 10/2012 Ota ..... F01C 21/10 417/410.1
2013/0017100 A1 1/2013 Ota et al.

* cited by examiner

ELECTRIC MOTOR VEHICLE VACUUM PUMP ARRANGEMENT

CROSS REFERENCE TO PRIOR APPLICATIONS

This application is a U.S. National Phase application under 35 U.S.C. § 371 of International Application No. PCT/EP2013/054438, filed on Mar. 5, 2013. The International Application was published in German on Sep. 12, 2014 as WO 2014/135202 A1 under PCT Article 21(2).

FIELD

The present invention relates to an electric vehicle vacuum pump assembly comprising a pump unit and a drive motor driving the pump unit.

BACKGROUND

An electrically driven vehicle vacuum pump in a vehicle generates a negative pressure of 100 millibars absolute which is, for example, required to operate a pneumatic brake force booster and/or other pneumatically operated ancillary units independent of the operating state of an internal combustion engine. In an electric vehicle vacuum pump assembly, the electric output of the drive motor typically lies in the range of 100 W in the case of small vacuum pumps, and several 100 W in the case of large vacuum pumps. In the vacuum pump assembly, corresponding amounts of heat losses occur both in the drive motor and in the pump unit, the heat losses having to be reliably dissipated to prevent overheating, particularly of the drive motor. Depending on the pump output and the rotational speed of the pump unit, sound emissions may be such that extensive measures for sound attenuation and/or creating an acoustic barrier must be taken.

DE 199 36 644 A1 describes an electric vacuum pump assembly where the sound insulation measure is a simple cover at the discharge side of the pump unit.

SUMMARY

An aspect of the present invention is to provide an electric vehicle vacuum pump assembly with a reliable cooling and with low sound emissions.

In an embodiment, the present invention provides an electric vehicle vacuum pump assembly which includes a combination, a separate acoustic barrier casing configured to encase the combination in each of a radially-spaced relationship and an axially-spaced relationship, and an annular gastight attenuation assembly radially arranged between the separate acoustic barrier casing on a first side and the combination on a second side. The combination comprises a pump unit and a drive motor comprising a rotor space, a stator space, a ventilation inlet, and a ventilation outlet. The rotor space comprises a motor rotor, and the stator space comprises a motor stator. The separate acoustic barrier casing comprises an intake connection and a discharge connection. The ventilation inlet and the ventilation outlet of the drive motor are configured to provide a forced ventilation past the annular gastight attenuation assembly and through at least one of the rotor space and the stator space.

BRIEF DESCRIPTION OF THE DRAWINGS

The present invention is described in greater detail below on the basis of embodiments and of the drawings in which.

DETAILED DESCRIPTION

Figure 1:
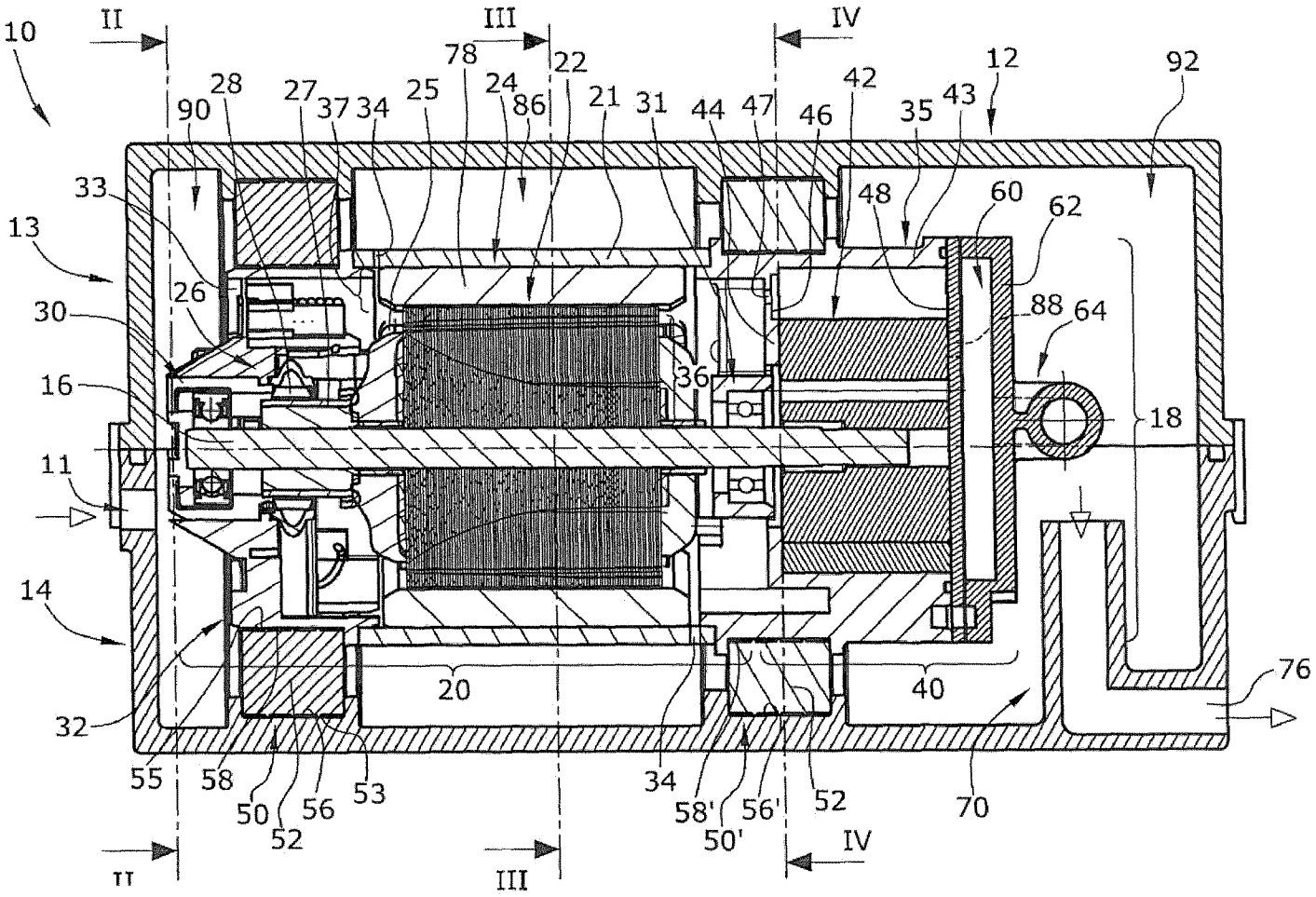
FIG. 1 shows a longitudinal section of an electric vehicle vacuum pump assembly.

The electric vehicle vacuum pump assembly according to the present invention comprises a combination of a, for example, rotary pump unit and a drive motor which can, for example, be coaxial with respect to the pump unit. The pump unit can, for example, be a vane-type pump unit, but may also be any other rotary and quasi-continuously delivering vacuum pump which is suitable to generate, at the required volumetric output, an absolute pressure of, for example, 100 millibars or less.

The drive motor comprises a rotor space in which the motor rotor rotates and which comprises a stator space in which the motor stator is arranged.

A separate acoustic barrier casing is further provided which encases the combination in a radially and an axially spaced relationship and which comprises its own intake connection and its own discharge connection. The intake connection of the acoustic barrier casing defines the intake connection of the vacuum pump assembly, and the discharge connection of the acoustic barrier casing defines the discharge of the vacuum pump assembly. The acoustic barrier casing is configured separately from a largely, but not necessarily completely, gastight separate casing of the combination and/or the electric drive motor. The acoustic barrier casing provides a considerable reduction of sound emissions issued by the vacuum pump assembly since the acoustic barrier casing encloses and encases the combination of pump unit and drive motor on all six sides.

An annular gastight body-borne sound attenuation assembly is provided radially between the acoustic barrier casing and the combination, the annular gastight body-borne sound attenuation assembly defining an attenuating mechanical suspension of the combination in the acoustic barrier casing. The attenuation assembly is gastight and is configured without openings so that an axial gas flow past the combination is, for example, prevented in the annular interspace between the combination and the acoustic barrier casing.

The drive motor comprises an axial ventilation inlet and an axial ventilation outlet so that, during operation of the assembly, the pump unit provides an axial forced ventilation past the attenuation assembly and through the rotor space and/or the stator space. The air taken in by the pump unit thus first axially flows through the interior of the drive motor so that the drive motor is continuously air-cooled during operation. The space in which the motor coils are arranged can, for example, be ventilated, i.e., in the case of an electronically commutated drive motor, the stator space, and in the case of a mechanically commutated drive motor, the rotor space. It is also possible, however, to ventilate both the stator space and the rotor space.

The attenuation assembly thus has two effects, i.e., a body-borne sound attenuating suspension of the pump unit/drive motor combination, and an axial forced ventilation of the drive motor.

In an embodiment of the present invention, the ventilation inlet of the drive motor can, for example, face axially away from the pump unit, and the ventilation outlet of the drive motor can, for example, axially face the pump unit. In an embodiment, the ventilation outlet of the drive motor and an air inlet of the pump unit can, for example, be in direct fluidic communication with each other. The ventilation outlet of the drive motor more or less directly defines the air inlet of the pump unit, i.e., the intake connection of the pump unit. The drive motor is thus arranged fluidically upstream of the pump unit so that the air taken in by the vacuum pump assembly first axially flows through the drive motor before it flows into the pump unit. Although, due to the vacuum of the, for example, 100 millibars absolute prevailing at the intake side of the pump unit, only relatively small air masses flow axially through the drive motor, this assembly offers the advantage that the temperature of the intake air flowing through the drive motor is relatively low. Sufficient air cooling of the drive motor can thereby be provided.

In an embodiment of the present invention, two gastight annular attenuation assemblies can, for example, be provided, an annular space being defined therebetween. The pump unit/drive motor combination is thus radially mounted and/or supported at two axial positions at the acoustic barrier casing. The two attenuation assemblies can be axially arranged approximately in the transverse plane of the rolling bearings, for example, to provide for a corresponding radial mounting and radial attenuation approximately in the transverse plane of the unbalance introduction of the unbalance generated by the two rotors. The mechanical attenuation of the combination movements is thereby improved without essentially increasing the transmission of body-borne sound from the combination to the acoustic barrier casing.

In an embodiment of the present invention, the annular space between the two gastight attenuation assemblies can, for example, be ventilated via a ventilation opening in the drive motor casing. The ventilation opening may be very small since it only serves for pressure compensation between the annular space and the interior of the drive motor. The ventilation opening provides that, in the annular space, approximately the same air pressure prevails as in the interior of the drive motor, for example, an air pressure of 100 millibars absolute. The sound transmission inside the annular space is thereby considerably degraded so that the sound emissions of the vacuum pump assembly are correspondingly reduced.

The annular space may optionally be filled with a sound-absorbing material which, however, does not establish any appreciable mechanical and/or force-transmitting connection between the combination and the acoustic barrier casing.

In an embodiment of the present invention, an attenuation assembly can, for example, be configured as an axial bearing which axially supports the pump unit/drive motor combination. A separate axial support of the combination with respect to the acoustic barrier casing is thus not required. The configuration of the attenuation assembly as an axial bearing may, for example, be realized in that the attenuation body is axially surrounded both at its outer circumference at the acoustic barrier casing side and at its inner circumference at the combination side by corresponding recesses and/or annular webs so that a stable axial fixing of the combination in the acoustic barrier casing is realized. The negative pressure in the acoustic barrier casing at the intake-side longitudinal end axially presses the pump unit/drive motor combination at a large force towards the intake side. A stable axial bearing is therefore required for the axial support.

In an embodiment of the present invention, the attenuation assembly can, for example, comprise an annular attenuation body which may be made of a plastic material, it can, however, also be made of a gastight elastomer without any openings. Elastomers may have good mechanical attenuation properties, wherein the degree of attenuation is adapted, for example, to be adjusted via the axial length of the attenuation body.

In an embodiment of the present invention, the attenuation assembly can, for example, comprise a lock against rotation which prevents the acoustic barrier casing from rotating with respect to the combination. In particular in the case of load changes, torque occurs between the combination and the acoustic barrier casing which would cause the combination to rotate in the acoustic barrier casing if not prevented by a corresponding lock against rotation. The lock against rotation may, for example, be realized by corresponding anti-rotation form fits between the attenuation body and the combination and/or the acoustic barrier casing.

In an embodiment of the present invention, the acoustic barrier casing can, for example, comprise rigid fastening elements at its outside which allow for a rigid and an unattenuated fastening of the overall vacuum pump assembly at a vehicle part. The vacuum pump assembly can, for example, be thereby rigidly attached to the vehicle body or to the internal combustion engine. Via the suspension of the combination decoupled by the attenuation assembly in the acoustic barrier casing, the transmission of body-borne sound from the combination to the vehicle on the one hand and the transmission of detrimental oscillations and vibrations from the vehicle to the combination on the other hand are to a large extent prevented.

In an embodiment of the present invention, the drive motor can, for example, comprise a mechanical commutating assembly which energizes the motor coils, the motor coils being provided, for example, at the rotor side. A mechanical commutating assembly is simple and inexpensive to manufacture but produces frictional heat due to commutator friction. The heat produced in the mechanical commutating assembly is permanently and reliably dissipated in connection with the forced ventilation, which can, for example, include a forced ventilation of the commutating assembly. The forced ventilation thereby allows for use of an inexpensive mechanical commutating assembly.

All types of rotary pump assemblies are generally suitable. A dry running vane-type pump unit can, for example, be used as a pump unit.

An embodiment of the present invention is hereinafter described in detail with reference to the drawings.

FIGS. 1-4 show an electric vehicle vacuum pump assembly 10 which serves to provide a vacuum of an absolute pressure of, for example, 100 millbars or less in a vehicle. The vacuum is mainly used as a potential energy for actuating elements, for example, for a pneumatic brake force booster or other pneumatic vehicle actuators. An electric drive for vehicle vacuum pumps is increasingly required since the internal combustion engine of a vehicle does not permanently run during vehicle operation.

The assembly 10 is essentially composed of three components, i.e., an electric drive motor 20, a pump unit 40 coaxially arranged with respect thereto, and an acoustic barrier casing 12 enclosing the combination 18 of pump unit 40 and electric drive motor 20 on all sides.

The electric drive motor 20 comprises a motor rotor 22 having a plurality of rotor coils 25 and a motor stator 24 having a plurality of stator plates 78. The motor rotor 22 is arranged for rotation with a rotor shaft 16 which also defines the rotor shaft for a pump rotor 42. The electric drive motor 20 is mechanically commutated by a mechanical commutator 26. The commutator 26 is defined by a slip ring 27 and brushes 28 running on the slip ring 27.

Figure 3:
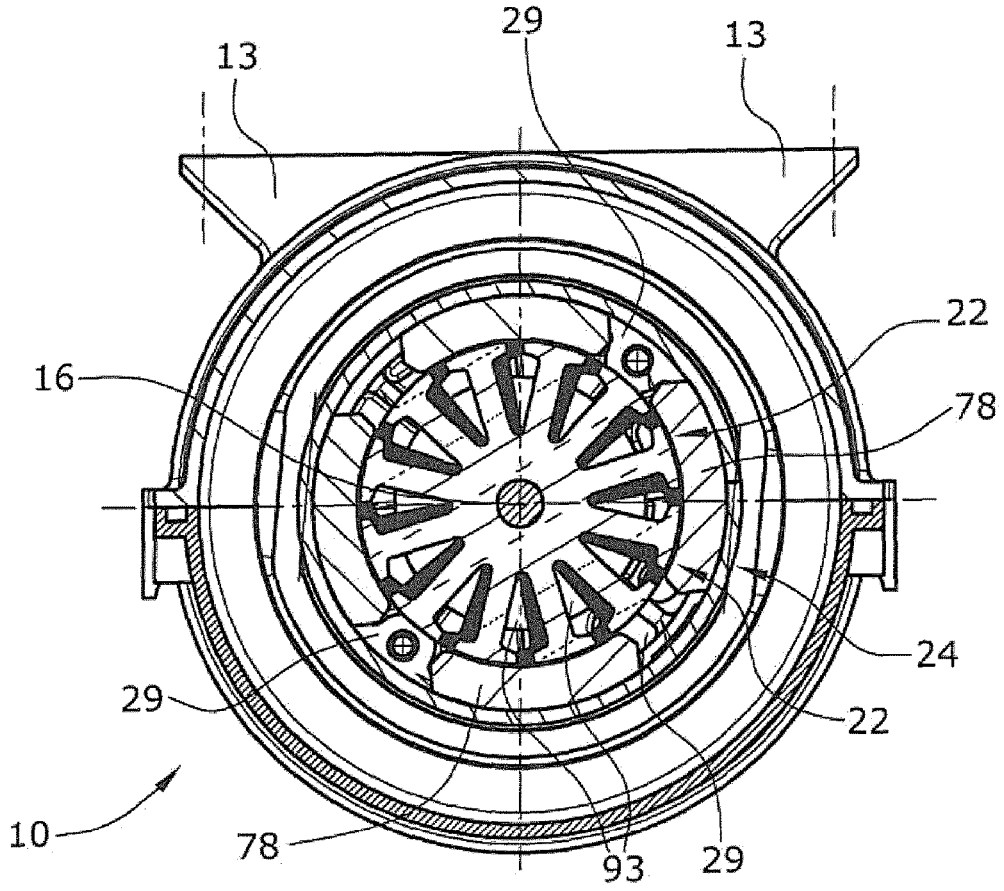
FIG. 3 shows a cross-section III-III of the vehicle vacuum pump assembly of FIG. 1.

The rotor shaft 16 is rotatably mounted in the combination 18 via two rolling bearings 30, 31, wherein the commutator 26 and the motor rotor 22 are arranged between the two rolling bearings 30, 31, while the pump rotor 42 is fixed for rotation and in an overhung manner at a rotor shaft end. The motor rotor 22 defines a cylindrical rotor space 36 permeable to air in the axial direction, said rotor space 36 being surrounded by an annular stator space 37 which is defined by the motor stator 24 also permeable to air in the axial direction. The air permeability of the motor stator 24 is realized by axial ventilation ducts 29 and the air permeability of the motor rotor 22 is realized by axial ventilation ducts 93 as can be seen in FIG. 3.

The electric drive motor 20 comprises an essentially cylindrical metallic drive motor casing wall 21 in the area of the motor stator 24 and the motor rotor 22, the drive motor casing wall 21 to a large extent acoustically and fluidically shielding the rotor space 36 and the stator space 37 radially towards the outside. The electric drive motor 20 comprises a plurality of air-permeable ventilation inlets 33 at its front side 32 facing away from the pump, through which air can axially flow into the rotor space 36 and the stator space 37. This air can flow out again through a drive motor ventilation outlet 47 in an inlet side front wall 44 at the pump-side front side of the electric drive motor 20 so that the rotor space 36 and the stator space 37 are ventilated. Via this forced ventilation, the motor rotor 22, the motor stator 24, as well as the commutator 26 are continuously air-cooled during operation of the pump assembly 10.

The pump unit 40 immediately axially joins the electric drive motor 20, the pump unit 40 being essentially defined by the pump rotor 42 and a pump casing 35 surrounding the pump rotor 42. The pump casing 35 is composed of the inlet-side front wall 44, an outlet-side front wall 48, and a circumferential wall 43. The inlet-side front wall 44 defines both a front wall for the electric drive motor 20 and for the pump unit 40. The pump unit 40 is in this case configured as a vane-type pump unit so that the pump rotor 42 comprises a plurality of displaceable vanes via which the pump space is divided in the circumferential direction into a plurality of rotating pump cells. In the inlet-side front wall 44 of the pump unit 40, a crescent-shaped pump chamber air inlet 46 is provided through which the air coming from the electric drive motor 20 flows into the rotating pump cells. In the outlet-side front wall 48 of the pump unit 40, a crescent-shaped outlet opening 88 is provided through which the compressed air from the passing pump cells is expelled.

At the outlet-side front wall 48, a pot-shaped sound insulation cover 62 is placed which encloses a front-side sound attenuation space 60 and comprises an angled air outlet duct 64. The compressed air expelled through the outlet opening 88 first travels into the front-side sound attenuation space 60 from where it flows out through the air outlet duct 64.

The combination 18 composed of the electric drive motor 20 and the pump unit 40 is surrounded by a separate acoustic barrier casing 12 which is made up of two plastic half shells 13, 14. The acoustic barrier casing 12 is essentially barrel-shaped and closed and comprises only two openings, i.e., an intake connection 11 in the inlet-side front wall 44, and a discharge connection 76 in the outlet side front wall 48 of the acoustic barrier casing 12.

The essentially cylindrical acoustic barrier casing 12 is arranged in spaced relationship to the combination 18 at all six sides so that the acoustic barrier casing 12 does not immediately contact the combination 18 at any location. The combination 18 is mounted in a manner attenuated by two attenuation assemblies 50, 50' in the acoustic barrier casing 12 but generally in a stationary manner. The two attenuation assemblies 50, 50' are respectively arranged approximately in the transverse plane of the two rolling bearings 30, 31. Each attenuation assembly 50, 50' is essentially defined by a respective annular and gastight elastomeric attenuation body 52 whose outer circumference 53 is fixed in an acoustic barrier casing-side attenuation body seat 56, 56' and whose inner circumference 55 is fixed in a combination-side attenuation body seat 58, 58'. The attenuation assembly 50' located in the transverse plane of the rolling bearing 31 arranged between the electric drive motor 20 and the pump unit 40 is configured as an axial bearing so that the combination 18 is axially supported at the acoustic barrier casing 12 in both longitudinal directions. The other attenuation assembly 50 is also configured as a single-sided axial bearing. The combination 18 is thereby additionally axially supported in a single-sided manner against the compressive forces axially acting upon the combination 18 in the direction of the intake connection 11. The attenuation bodies 52 comprise a plurality of narrow circumferential annular lips both at their inner circumference 55 and their outer circumference 53.

Between the acoustic barrier casing 12 and the combination 18, a plurality of spaces 90, 86, 92 are defined which are separated from each other by the two attenuation assemblies 50, 50'. At the intake connection side, an inlet attenuation space 90 is defined into which air flows through the intake connection 11 of the acoustic barrier casing 12 and out of which the air flows through the ventilation inlets 33 of the drive motor into the interior of the motor. An annular space 86 is defined axially between the two attenuation assemblies 50, 50', the annular space 86 being defined at the radial outside by the acoustic barrier casing 12 and at the inside by the drive motor casing wall 21. The annular space 86 is ventilated via a ventilation opening 34 in the drive motor casing wall 21 so that the same air pressure prevails in the annular space 86 as in the rotor space 36 and in the stator space 37.

At the discharge connection side, the acoustic barrier casing 12 encloses a sound attenuation space 92 into which flows the air compressed by the pump unit 40 coming from the angled air outlet duct 64. From the sound attenuation space 92, the compressed air flows out of the sound attenuation space 92 through a perpendicularly bent outlet duct 70 towards the outside.

Figure 2:
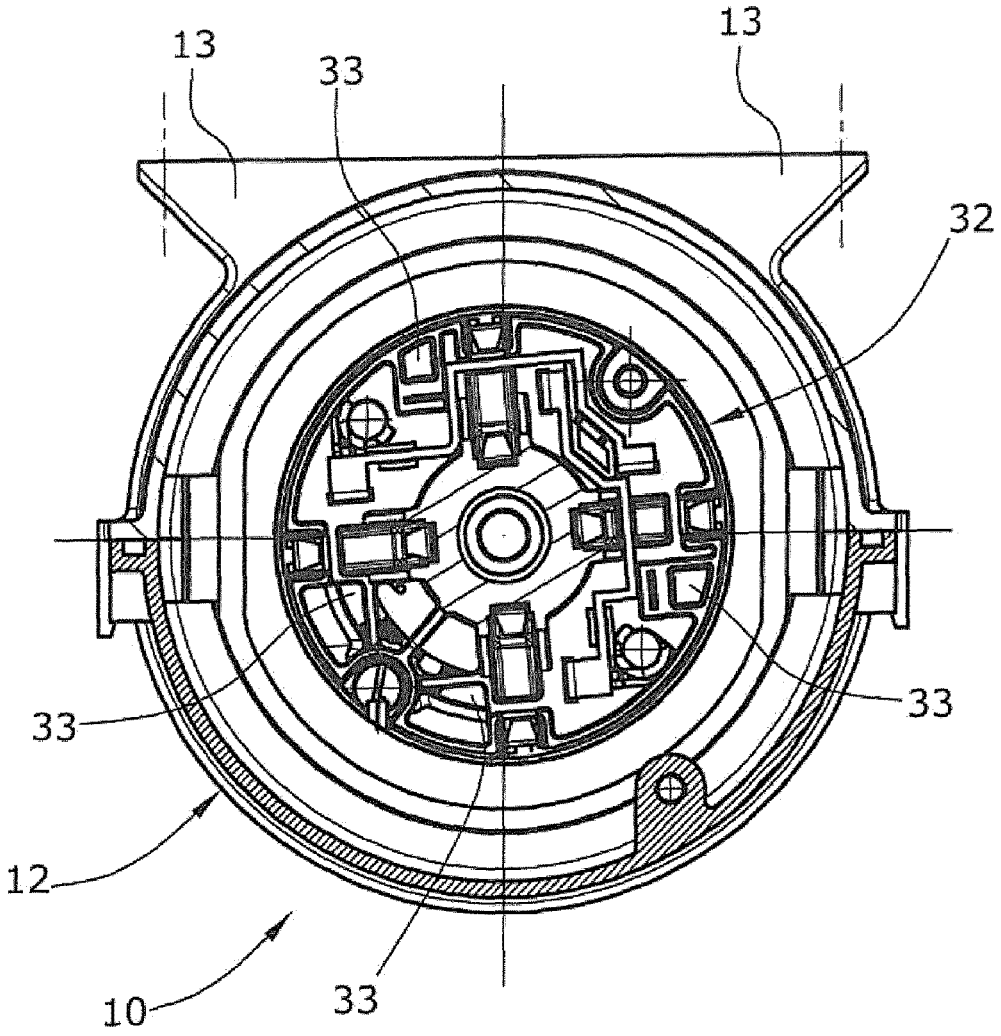
FIG. 2 shows a cross-section II-II of the vehicle vacuum pump assembly of FIG. 1.

As can be seen in FIGS. 2 and 3, the acoustic barrier casing 12 comprises a plurality of plastic half shells 13, 13' as rigid fastening elements via which the assembly 10 can be rigidly fixed to the vehicle body or directly to the internal combustion engine of the vehicle without any further attenuation.

Figure 4:
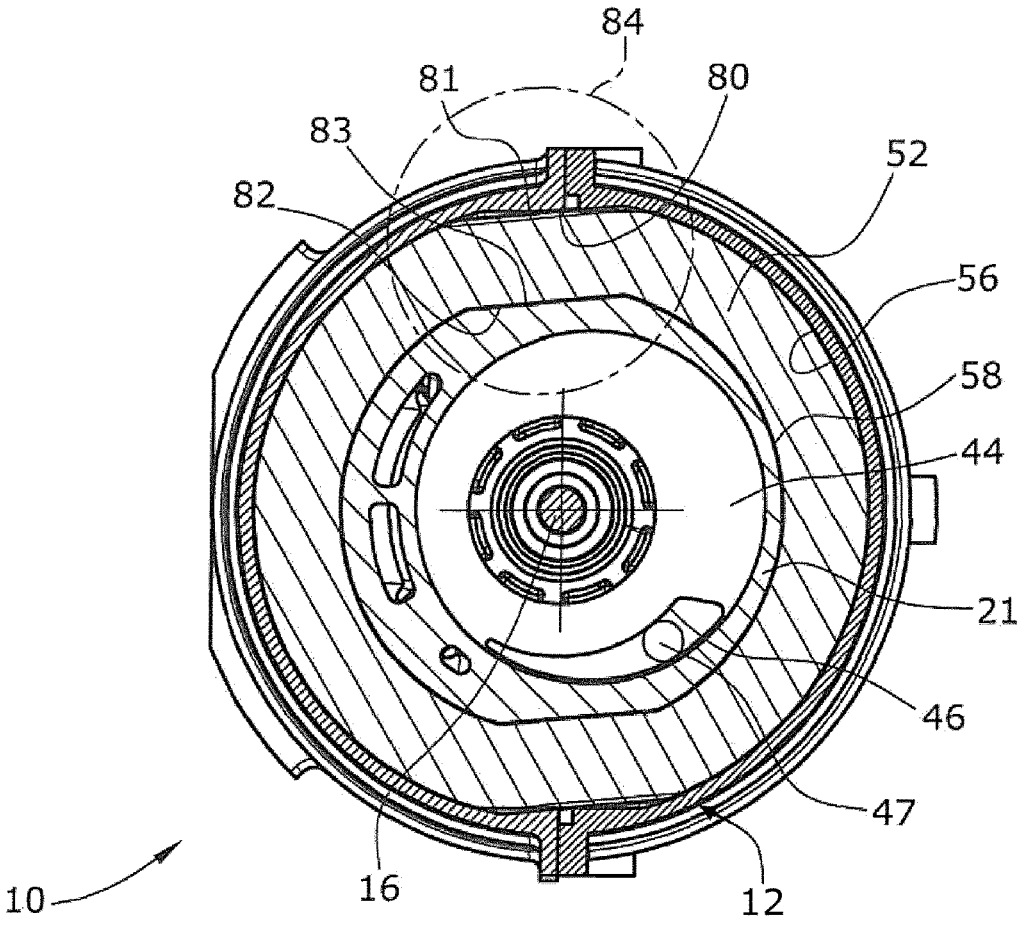
FIG. 4 shows a cross-section IV-IV of the vehicle vacuum pump assembly of FIG. 1.

FIG. 4 shows a cross-section of the attenuation assembly 50'. The attenuation body 52 is not configured circularly across its entire circumference, but comprises flattened portions 82, 81 on the inside and on the outside to define a lock against rotation 84, the flattened portions 82, 81 corresponding to flattened portions 83, 80 at the outer circumference of the drive motor casing wall 21 and/or at the inner circumference of the acoustic barrier casing 12.

Although the present invention has been described and illustrated with reference to specific illustrative embodiments thereof, it is not intended that the present invention be limited to those illustrative embodiments. Those skilled in the art will recognize that variations and modifications can be made without departing from the true scope of the present invention as defined by the claims that follow. It is therefore intended to include within the present invention all such variations and modifications as fall within the scope of the appended claims and equivalents thereof.

What is claimed is:

1. An electric vehicle vacuum pump assembly comprising:

a combination comprising:

a pump unit, and a drive motor comprising a rotor space, a stator space, a ventilation inlet, and a ventilation outlet, the rotor space comprising a motor rotor, and the stator space comprising a motor stator;

a separate acoustic barrier casing configured to encase the combination radially and axially, the separate acoustic barrier casing comprising an intake connection and a discharge connection; and an annular gastight attenuation assembly comprising an annular attenuation body, the annular gastight attenuation assembly being radially arranged between the separate acoustic barrier casing on a first side and the combination on a second side, wherein, the ventilation inlet and the ventilation outlet of the drive motor are configured to provide a ventilation past the annular gastight attenuation assembly and through at least one of the rotor space and the stator space, the annular gastight attenuation assembly is configured as an axial bearing which axially supports the combination, and the configuration of the annular gastight attenuation assembly as the axial bearing is provided by the annular attenuation body being axially surrounded both at its outer circumference at a side of the separate acoustic barrier casing and at its inner circumference at a side of the combination by at least one of recesses and annular webs so as to provide a stable axial fixing of the combination in the separate acoustic barrier casing.

2. The pump assembly as recited in claim 1, wherein the pump unit is a rotary pump unit arranged coaxially with respect to the drive motor.

3. The pump assembly as recited in claim 1, wherein, the pump unit comprises an air inlet, and the ventilation outlet of the drive motor and the air inlet of the pump unit are in a fluidic communication with each other.

4. The pump assembly as recited in claim 1, further comprising two annular gastight attenuation assemblies which together define an annular space therebetween.

5. The pump assembly as recited in claim 4, wherein, the drive motor further comprises a drive motor casing comprising a ventilation opening, and the annular space is ventilated via the ventilation opening.

6. The pump assembly as recited in claim 4, wherein the two annular gastight attenuation assemblies each comprise an annular attenuation body.

7. The pump assembly as recited in claim 6, wherein each annular attenuation body is made of a gastight elastomer.

8. The pump assembly as recited in claim 1, wherein the ventilation inlet faces axially away from the pump unit, and the ventilation outlet axially faces the pump unit.

9. The pump assembly as recited in claim 1, wherein the annular attenuation body is made of a gastight elastomer.

10. The pump assembly as recited in claim 1, wherein the annular gastight attenuation assembly and the separate acoustic barrier casing are configured to prevent a rotation of the separate acoustic barrier casing with respect to the combination.

11. The pump assembly as recited in claim 1, wherein the separate acoustic barrier casing further comprises rigid fastening elements configured to allow a rigid fastening of the electric vehicle vacuum pump assembly to a vehicle part.

12. The pump assembly as recited in claim 1, wherein the drive motor further comprises a mechanical commuting assembly.

13. The pump assembly as recited in claim 1, wherein the pump unit is a vane-type pump unit.

* * * * *